US010658140B2

(12) United States Patent
Itoda et al.

(10) Patent No.: US 10,658,140 B2
(45) Date of Patent: May 19, 2020

(54) CONTACT MECHANISM AND ELECTROMAGNETIC RELAY USING THE SAME

(71) Applicant: OMRON Corporation, Kyoto (JP)

(72) Inventors: Shuichi Itoda, Shiga (JP); Masayuki Noda, Kumamoto (JP); Koji Takami, Kyoto (JP); Takeshi Nishida, Shiga (JP)

(73) Assignee: Omron Corporation, Kyoto (JP)

( * ) Notice: Subject to any disclaimer, the term of this patent is extended or adjusted under 35 U.S.C. 154(b) by 170 days.

(21) Appl. No.: 15/808,641

(22) Filed: Nov. 9, 2017

(65) Prior Publication Data

US 2018/0068818 A1 Mar. 8, 2018

Related U.S. Application Data

(63) Continuation of application No. PCT/JP2016/057153, filed on Mar. 8, 2016.

(51) Int. Cl.
*H01H 9/30* (2006.01)
*H01H 50/38* (2006.01)
(Continued)

(52) U.S. Cl.
CPC ..... *H01H 50/38* (2013.01); *H01H 9/44* (2013.01); *H01H 50/04* (2013.01)

(58) Field of Classification Search
CPC ..... H01H 9/00; H01H 51/22; H01H 50/38; H01H 50/54
(Continued)

(56) References Cited

U.S. PATENT DOCUMENTS 4,922,216 A * 5/1990 Dietrich ..... H01H 50/643 335/128
5,117,209 A * 5/1992 Sato ..... H01H 50/026 335/80
(Continued)

FOREIGN PATENT DOCUMENTS

CN 102820172 A 12/2012
CN 104412353 A 3/2015
(Continued)

OTHER PUBLICATIONS

Office Action issued in Chinese Application No. 201680022644.8, dated Aug. 3, 2018 (14 pages).
(Continued)

*Primary Examiner* — Shawki S Ismail
*Assistant Examiner* — Lisa N Homza
(74) *Attorney, Agent, or Firm* — Osha Liang LLP

(57) ABSTRACT

A contact mechanism has a base, a pair of fixed contact terminals provided side by side on the base, a first contact mechanism including a first fixed contact provided in one of the pair of fixed contact terminals, and a first movable contact that contactably and separably faces the first fixed contact, a second contact mechanism including a second fixed contact provided in another of the pair of fixed contact terminals, and a second movable contact that contactably and separably faces the second fixed contact, and a magnetic field generation unit having a permanent magnet disposed between the first contact mechanism and the second contact mechanism such that magnetic fields in opposite directions are generated respectively between contacts of the first contact mechanism and between contacts of the second contact mechanism when currents in opposite directions flow in the first contact mechanism and the second contact mechanism.

10 Claims, 10 Drawing Sheets

(51) Int. Cl.
*H01H 9/44* (2006.01)
*H01H 50/04* (2006.01)

(58) Field of Classification Search
USPC ..... 335/201
See application file for complete search history.

(56) References Cited

U.S. PATENT DOCUMENTS 5,264,812 A * 11/1993 Tomono ..... H01H 51/2245 335/78
5,332,986 A * 7/1994 Wieloch ..... H01H 71/323 335/128
5,357,230 A * 10/1994 Mikawa ..... H01H 51/2281 335/128
5,359,305 A * 10/1994 Kitamura ..... H01H 50/16 335/78
5,382,934 A * 1/1995 Hendel ..... H01H 51/005 335/159
5,394,127 A * 2/1995 Hendel ..... H01H 1/26 335/128
5,612,658 A * 3/1997 Hendel ..... H01H 51/005 335/78
5,867,081 A * 2/1999 Arnoux ..... H01H 51/22 335/132
5,880,653 A * 3/1999 Yamada ..... H01H 49/00 335/78
5,880,654 A * 3/1999 Yamaguchi ..... H01H 50/641 335/124
5,889,452 A * 3/1999 Vuilleumier ..... H01H 50/005 257/421
5,889,454 A * 3/1999 Hendel ..... H01H 50/36 335/177
5,907,268 A * 5/1999 Mader ..... H01H 50/042 335/130
5,910,759 A * 6/1999 Passow ..... H01H 51/2227 335/113
5,929,730 A * 7/1999 Hendel ..... H01H 49/00 335/128
5,949,315 A * 9/1999 Kalb ..... H01H 51/2209 335/179
5,959,518 A * 9/1999 Passow ..... H01H 71/58 335/113
6,034,582 A * 3/2000 Fausch ..... H01H 50/026 335/128
8,482,368 B2 * 7/2013 Sasaki ..... H01H 9/443 335/201
8,680,957 B2 * 3/2014 Kato ..... H01H 50/043 335/202
8,797,129 B2 * 8/2014 Naka ..... H01H 50/36 335/126
8,823,473 B2 * 9/2014 Fujita ..... H01H 50/24 335/128
8,901,445 B2 * 12/2014 Tachikawa ..... H01H 9/40 218/26
9,570,259 B2 * 2/2017 Hasegawa ..... H01H 50/58
2003/0090351 A1 * 5/2003 Chen ..... H01H 9/42 335/132
2009/0066450 A1 * 3/2009 Yano ..... H01H 49/00 335/203
2012/0313737 A1 12/2012 Iwamoto et al.
2013/0021121 A1 * 1/2013 Uchida ..... H01H 1/54 335/131
2013/0021122 A1 * 1/2013 Uchida ..... H01H 1/54 335/131
2013/0057369 A1 * 3/2013 Yano ..... H01H 1/66 335/156
2013/0240495 A1 * 9/2013 Yano ..... H01H 9/36 219/123
2015/0048908 A1 * 2/2015 Isozaki ..... H01H 1/54 335/6
2015/0194284 A1 7/2015 Uruma et al.
2017/0076893 A1 * 3/2017 Tsutsui ..... H01H 50/023
2017/0301495 A1 * 10/2017 Hayashida ..... H01H 50/38
2017/0301496 A1 * 10/2017 Hayashida ..... H01H 50/38
2017/0309429 A1 * 10/2017 Hayashida ..... H01H 50/02

FOREIGN PATENT DOCUMENTS

JP S60-107551 U 7/1985
JP H10-154448 A 6/1998
JP 2009-087918 A 4/2009
JP 2011-204478 10/2011
JP 2012-160427 A 8/2012
JP 2013-080692 A 5/2013
JP 2013-164900 A 8/2013
JP 2013-232300 A 11/2013

OTHER PUBLICATIONS

International Search Report issued in corresponding Application No. PCT/JP2016/057153, dated Jun. 7, 2016 (2 pages).
Written Opinion issued in corresponding Application No. PCT/JP2016/057153, dated Jun. 7, 2016 (3 pages).

* cited by examiner

CONTACT MECHANISM AND ELECTROMAGNETIC RELAY USING THE SAME

BACKGROUND

Technical Field

The present invention relates to a contact mechanism, and especially relates to a contact mechanism that induces generated arcs in the same direction.

Related Art

As a contact mechanism, there has been an electromagnetic relay including: an armature swung by excitation and non-excitation of an electromagnetic block; a movable contact portion having a movable contact, mounted in the armature, and swinging together with swing of the armature; and a fixed contact portion having a fixed contact which the movable contact comes into contact with or separates from. The electromagnetic relay is provided with a magnetic field generation unit that has an arc extension space to extend an arc generated when the movable contact comes into contact with and separates from the fixed contact, and guides to the arc extension space an arc that is generated when the movable contact comes into contact with or separates from the fixed contact (Patent Document 1).

The above electromagnetic relay is configured to induce an arc, generated between a fixed contact 22*a* and a movable contact 21*a* facing each other, to an arc extension space S above a base 30 to cut off the arc, as shown in FIGS. 7 and 8 of Patent Document 1.

Patent Document 1: Japanese Unexamined Patent Publication No. 2013-80692

SUMMARY

However, as shown in FIG. 4 of Patent Document 1, in the above electromagnetic relay, a permanent magnet 50 is disposed with respect to each of four pairs of the fixed contact 22*a* and the movable contact 21*a* facing each other. This leads to high component count, and high assembly man-hour as well.

Further, since a space for providing each of the four permanent magnets 50 needs to be ensured, the device is not easily reduced in size and the design flexibility is thus low.

A contact mechanism according to one or more embodiments of the present invention has low component count and low assembly man-hour, with ease to reduce a device size, and with high design flexibility.

A contact mechanism according to one or more embodiments of the present invention includes a base; a first contact mechanism in which a first movable contact is made to contactably and separably face a first fixed contact provided in one of a pair of fixed contact terminals provided side by side to the base; and a second contact mechanism in which a second movable contact is made to contactably and separably face a second fixed contact provided in the other of the fixed contact terminals. The contact mechanism has a configuration where a magnetic field generation unit provided with a permanent magnet is disposed between the first contact mechanism and the second contact mechanism such that magnetic fields in opposite directions are generated respectively between the contacts of the first contact mechanism and between the contacts of the second contact mechanism when currents in opposite directions are allowed to flow in the first contact mechanism and the second contact mechanism.

According to one or more embodiments of the present invention, one permanent magnet generates magnetic fields in the opposite directions respectively between the contacts of the first contact mechanism and between the contacts of the second contact mechanism. It is thereby possible to obtain a contact mechanism with low component count and low assembly man-hour.

Further, a space for disposing the permanent magnet can be saved. It is thus possible to obtain a contact mechanism with ease to reduce a device size and with high design flexibility.

Note that "between the first contact mechanism and the second contact mechanism" means a region sandwiched between a second plane and a third plane, the second plane being vertical to a first plane passing through the first and second fixed contacts and the first and second movable contacts, the second plane passing through the first fixed contact and the first movable contact, the third plane being vertical to the first horizontal plane and passing through the second fixed contact and the second movable contact.

According to one or more embodiments of the present invention, the magnetic field generation unit may be disposed in the base so as to induce arcs generated in the first contact mechanism and the second contact mechanism in directions moving away from the base.

Accordingly, since a generated arc is induced in the direction moving away from the base, the arc does not come into contact with the base or a base portion of the fixed contact terminal. Hence dust or organic gas is not generated and contact failure can be prevented, to obtain a contact mechanism with a long contact life.

According to one or more embodiments of the present invention, the magnetic field generation unit may have a yoke in contact with the permanent magnet.

Accordingly, adjusting the shape of the yoke or the contact position at which the yoke is in contact with the permanent magnet can change a direction of lines of magnetic force to a desired direction. Hence the arc inducing direction can be adjusted, and leakage of a magnetic flux is reduced to obtain a contact mechanism with high magnetic efficiency.

According to one or more embodiments of the present invention, the yoke may have a gate shape with a pair of arms facing each other across the first contact mechanism and the second contact mechanism.

Accordingly, since an arm of the yoke is disposed on each side of the permanent magnet, the leakage of the magnetic flux is further reduced to obtain a contact mechanism with favorable magnetic efficiency.

According to one or more embodiments of the present invention, the yoke may have a frame shape surrounding the first contact mechanism and the second contact mechanism.

Accordingly, the lines of magnetic force generated from the permanent magnet form a magnetic circuit via the frame-shaped yoke, to obtain a contact mechanism with favorable magnetic efficiency.

The electromagnetic relay according to one or more embodiments of the present invention has one of the contact mechanism described above.

According to one or more embodiments of the present invention, one permanent magnet generates magnetic fields in the opposite directions between the contacts of the first contact mechanism and between the contacts of the second contact mechanism. It is thereby possible to obtain an electromagnetic relay with low component count, low assembly man-hour, and high productivity.

Further, a space for disposing the permanent magnet can be saved. It is thus possible to obtain an electromagnetic relay with ease to reduce a device size and with high design flexibility.

DETAILED DESCRIPTION

Embodiments of the present invention will be described with reference to the accompanied drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
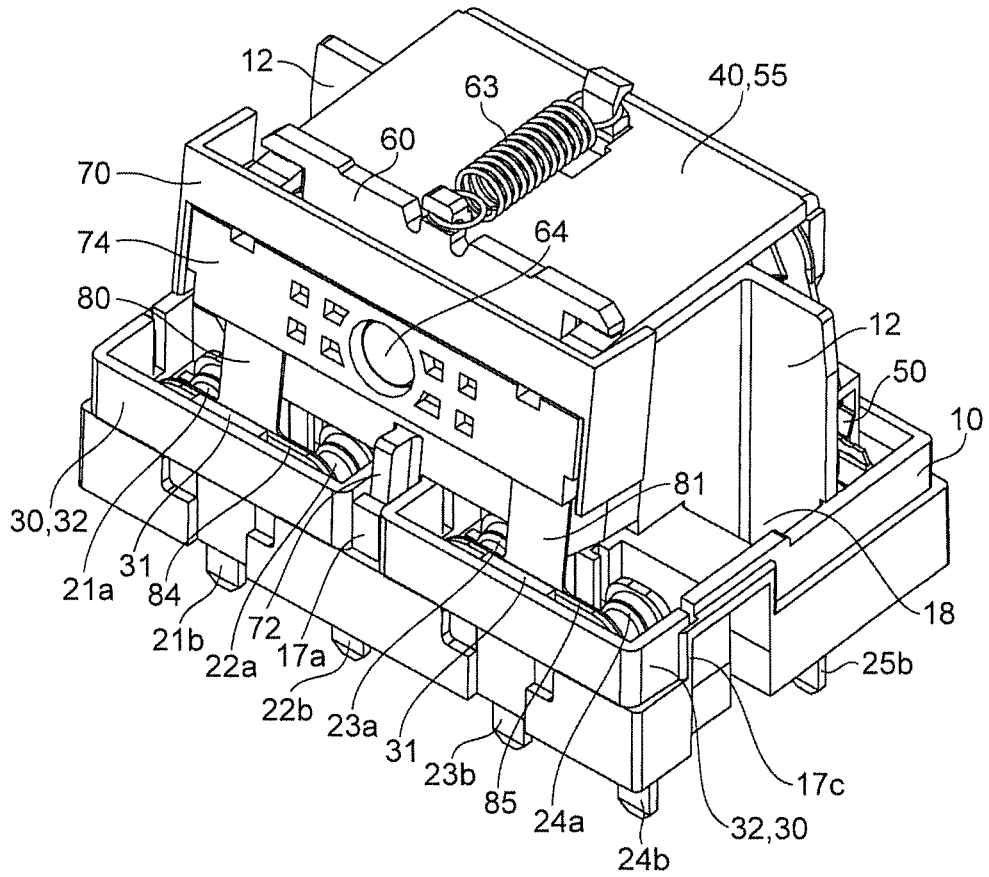
FIG. 1 is a perspective view illustrating an electromagnetic relay incorporating a contact mechanism according to a first embodiment of the present invention.
Figure 2:
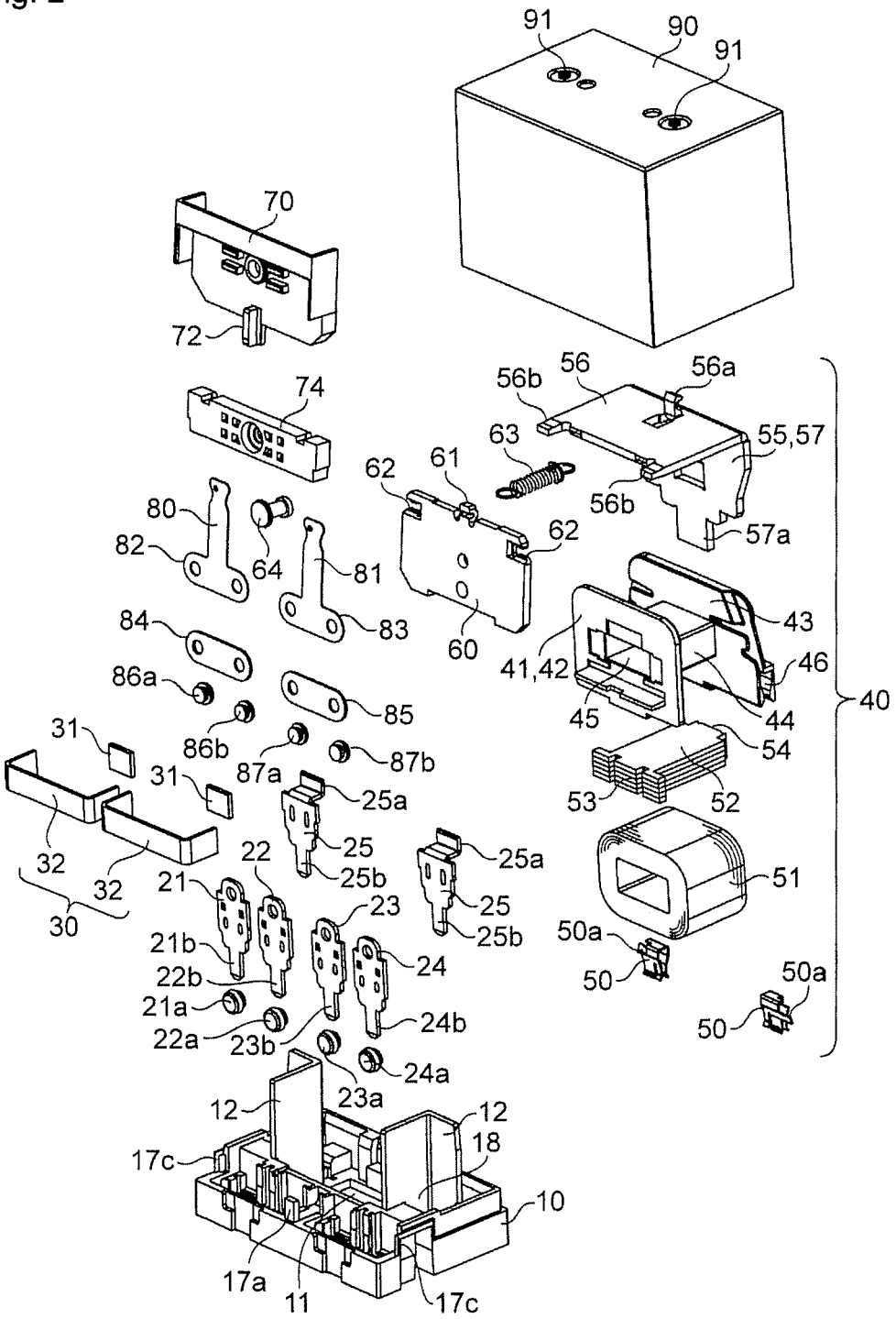
FIG. 2 is an exploded perspective view of the electromagnetic relay illustrated in FIG. 1.
Figure 3:
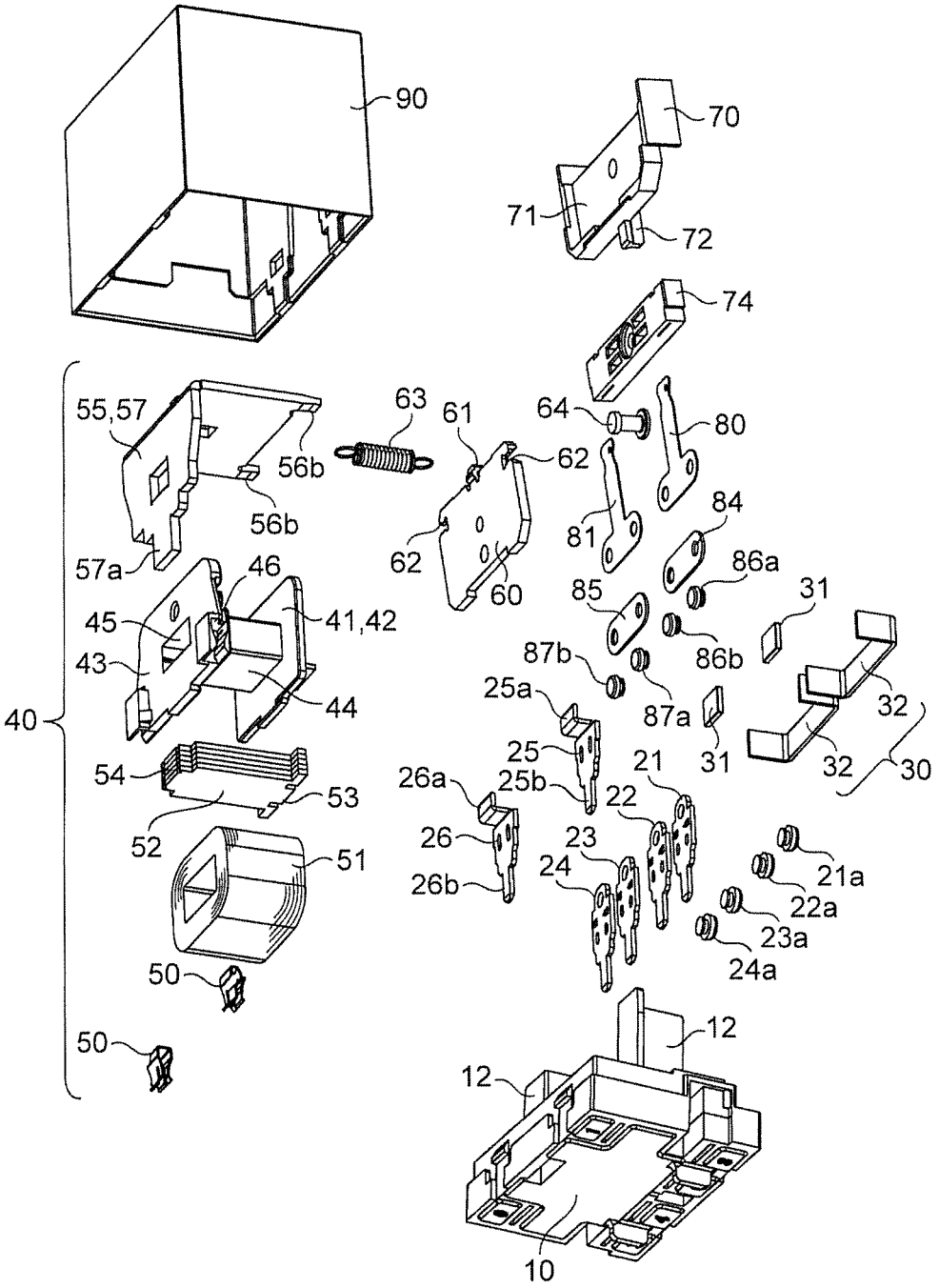
FIG. 3 is an exploded perspective view of the electromagnetic relay illustrated in FIG. 1, seen from another angle.

A contact mechanism according to a first embodiment is one in the case of being applied to an electromagnetic relay (FIGS. 1 to 8). As shown in FIGS. 2 and 3, the contact mechanism is briefly made up of a base 10, fixed contact terminals 21 to 24, a magnetic field generation unit 30, an electromagnetic block 40, a movable iron piece 60, movable contact pieces 80, 81, and a cover 90. Note that FIG. 1 does not illustrate the cover 90 for the convenience of description.

In the following description, in describing configurations represented in the drawings, terms showing directions such as "up", "down", "left", and "right", and other terms including those, will be used. It is noted that the purpose for using those terms is to facilitate understanding of the embodiments through the drawings. Accordingly, those terms do not necessarily show directions used at the time of actually using the embodiments of the present invention. A technical scope of the invention recited in the claims shall not be restrictively interpreted by using those terms.

Figure 4:
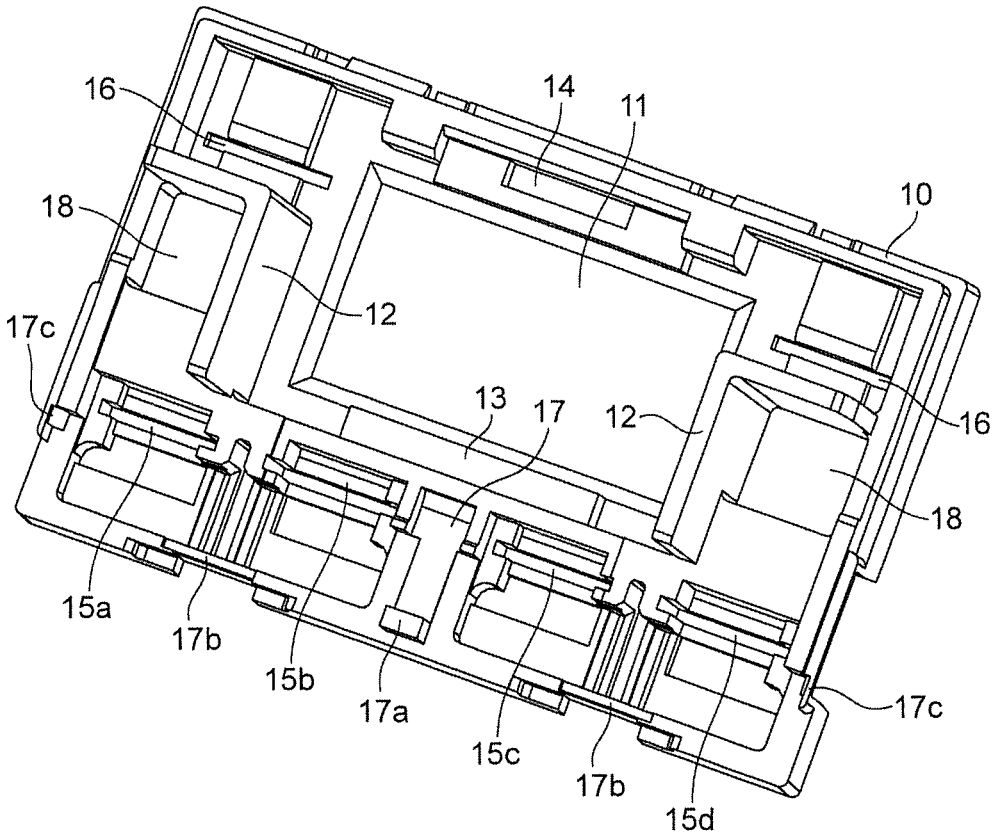
FIG. 4 is an enlarged perspective view of a base illustrated in FIG. 2.

As illustrated in FIG. 4, in the base 10, a pair of partitions 12, 12 with substantially L-shaped sections are provided in a projecting manner on both right and left sides of a depression 11 provided at the center of the upper surface. Further, in the base 10, a step 13 is provided at one of front and rear edges facing each other across the depression 11, and a press-fitting hole 14 is provided at the other of the edges. The step 13 is for supporting of a spool 41 of the electromagnetic block 40, described later. The press-fitting hole 14 is for press-fitting by a lower end 57*a* of a yoke 55 in the electromagnetic block 40. Moreover, in the base 10, terminal holes 15*a*, 15*b*, 15*c*, 15*d* are provided on the same straight line along one of edges facing each other on the upper surface, and terminal holes 16, 16 are provided along the other of the edges. A guiding recess 17 is disposed between the terminal holes 15*b*, 15*c*. An aligning projection 17*a* is provided in a projecting manner at the outer side edge facing the guiding recess 17. Aligning recesses 17*b*, 17*b* are provided at both sides of the aligning projection 17*a*. Furthermore, in the base 10, aligning ribs 17*c*, 17*c* are provided in a projecting manner near the outer side edges of the terminal holes 15*a*, 15*d*. In addition, in the base 10, arc elimination spaces 18, 18 are formed respectively between the partitions 12, 12 and the terminal holes 15*a*, 15*d*.

According to the first embodiment, there is an advantage to avoiding an increase in size of the electromagnetic relay by effectively using a dead space of the base 10 as the arc elimination space 18.

As illustrated in FIGS. 2 and 3, fixed contacts 21*a* to 24*a* are fixed to the upper ends of the fixed contact terminals 21 to 24. Further, terminal portions 21*b* to 24*b* are provided at the lower ends of the fixed contact terminals 21 to 24. By inserting the terminal portions 21*b* to 24*b* respectively into the terminal holes 15*a* to 15*d* in the base 10, the fixed contacts 21*a* to 24*a* are aligned on the same straight line. Four fixed contacts 21*a* to 24*a* are arranged in this manner so as to prevent generation of an arc by decreasing a load voltage that is applied to each of the fixed contacts 21*a* to 24*a* when a direct current power circuit is opened or closed.

Note that coil terminals 25 each have a connector 25*a* having a bent shape on its upper end and a terminal portion 25*b* on its lower end. By inserting the terminal portion 25*b* into the terminal hole 16 in the base 10, the coil terminals 25, 25 are aligned on the same straight line.

As illustrated in FIGS. 2, 3, 7, and 8, the magnetic field generation unit 30 is made up of a permanent magnet 31 having a parallelepiped shape and a yoke 32 with a substantially gate-shaped section. The yoke 32 is assembled along the edge of the base 10 such that the surface of the yoke 32, joined to the permanent magnet 31, faces the fixed contacts 21*a*, 22*a*, 23*a*, 24*a*.

Figure 7:
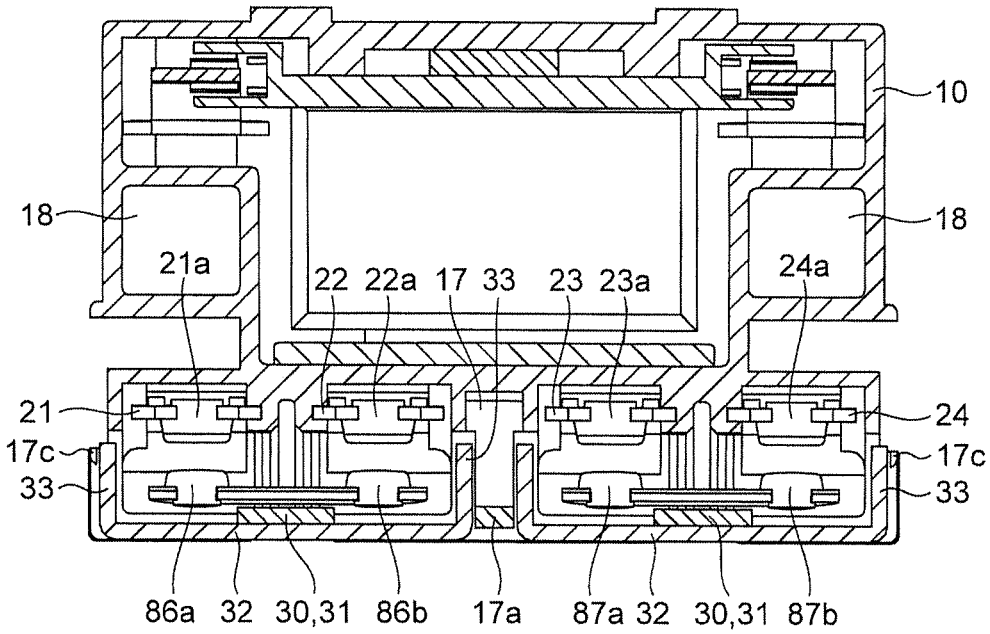
FIG. 7 is a cross sectional view of the electromagnetic relay illustrated in FIG. 1.

That is, as illustrated in FIG. 7, the permanent magnets 31, 31 are aligned by being engaged respectively into the aligning recesses 17*b*, 17*b* (FIG. 4) provided in the base 10.

More specifically, the permanent magnet 31 is disposed in a region surrounded by a second plane and a third plane which are vertical to a first plane (a plane parallel to the drawing plane in FIG. 7).

The first plane here refers to a plane passing through the movable contacts 86*a* (87*a*), 86*b* (87*b*) and the fixed contacts 21*a* (23*a*), 22*a* (24*a*) (a plane parallel to the drawing plane in FIG. 7). The second plane is a plane passing through the movable contacts 86*a* (87*a*) and the fixed contacts 21*a* (23*a*). The third plane is a plane passing through the movable contacts 86*b* (87*b*) and the fixed contacts 22*a* (24*a*). Note that, according to one or more embodiments of the present invention, the permanent magnet 31 is disposed at the center between the second plane and the third plane on the first plane.

Further, the permanent magnet 31 is disposed in a direction in which the movable contacts 86*a*, 86*b*, 87*a*, 87*b* respectively come into contact with or separate from the fixed contacts 21*a*, 22*a*, 23*a*, 24*a*. That is, the permanent magnet 31 is disposed in the direction of the movable contacts 86*a*, 86*b*, 87*a*, 87*b* side as seen from the fixed contacts 21*a*, 22*a*, 23*a*, 24*a*.

Meanwhile, the yokes 32, 32 are aligned by respectively bringing arms 33, 33 thereof into contact with the aligning projection 17*a* and the aligning ribs 17*c* in the base 10. The magnetic pole face of the permanent magnet 31 is joined to the surface of the yoke 32 in the direction in which the arms 33, 33 extend, the yoke 32 having a substantially gate-shaped section.

The movable contact 86*a* and the movable contact 86*b* are electrically connected with each other by a movable contact piece 80. For this reason, a direction of a current flowing between the fixed contact 21*a* and the movable contact 86*a* is opposite to a direction of a current flowing between the fixed contact 22*a* and the movable contact 86*b*, the directions being adjacent to each other.

Similarly, the movable contact 87*a* and the movable contact 87*b* are electrically connected with each other by a movable contact piece 81. For this reason, a direction of a current flowing between the fixed contact 23*a* and the movable contact 87*a* is opposite to a direction of a current flowing between the fixed contact 24*a* and the movable contact 87*b*, the directions being adjacent to each other.

The direction of the magnetic pole of the permanent magnet 31 is set such that, when the currents are allowed to flow respectively between the fixed contact 21*a* and the movable contact 86*a* and between the fixed contact 22*a* and the movable contact 86*b* in the opposite directions, generated arcs are induced in the direction moving away from the base 10.

Figure 8:
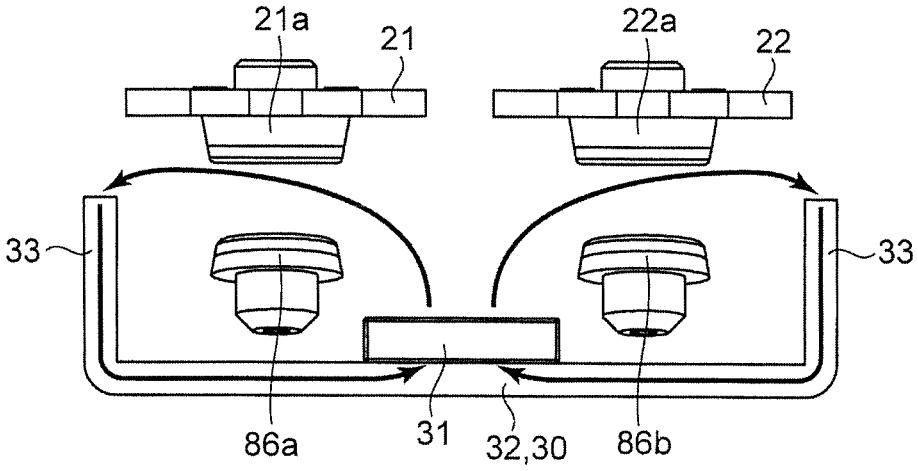
FIG. 8 is a schematic view illustrating a contact mechanism of the electromagnetic relay illustrated in FIG. 1.

Specifically, as illustrated in FIG. 8, the permanent magnet 31 is disposed such that magnetic fields in the opposite directions are generated between the fixed contact 21*a* (23*a*) and the movable contact 86*a* (87*a*) and between the fixed contact 22*a* (24*a*) and the movable contact 86*b* (87*b*). In other words, the permanent magnet 31 is disposed such that lines of magnetic force in the opposite directions are generated between the fixed contact 21*a* (23*a*) and the movable contact 86*a* (87*a*) and between the fixed contact 22*a* (24*a*) and the movable contact 86*b* (87*b*).

Further, by adjustment of its shape or position, the yoke 32 can change the direction of lines of magnetic force generated from the permanent magnet 31 to a desired direction. Thus, by adjustment of the arc inducing direction, the yoke 32 can reduce leakage of the magnetic flux of the permanent magnet 31 and enhance the magnetic efficiency.

Figure 6:
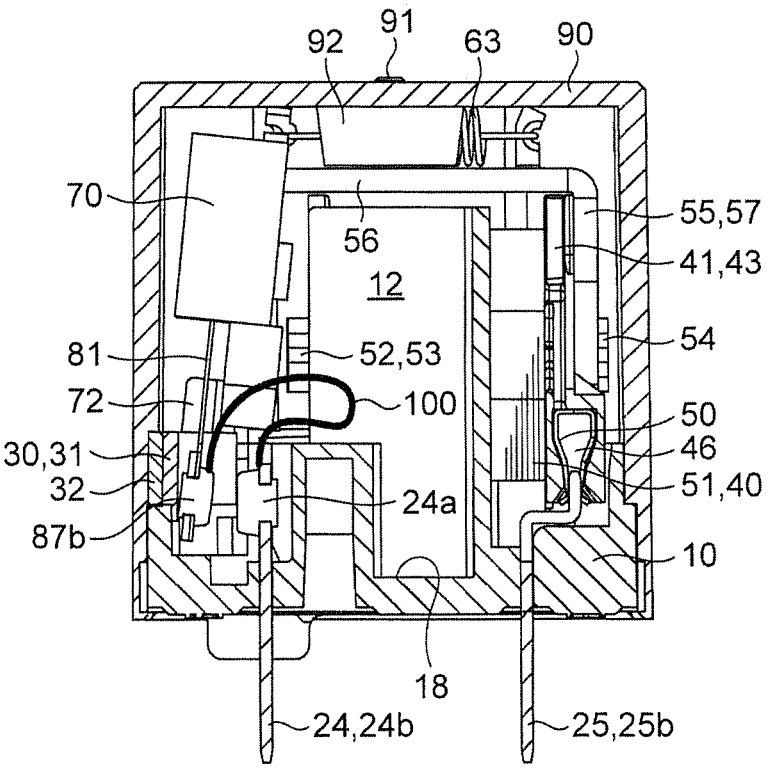
FIG. 6 is a vertical sectional view of a different position of the electromagnetic relay illustrated in FIG. 1.

For example, as illustrated in FIG. 6, the permanent magnet 31 and the yoke 32 are disposed so as to induce an arc 100 generated between the fixed contact 24*a* and the movable contact 87*b* in the direction moving away from the base 10. Further, the permanent magnet 31 and the yoke 32 are disposed so as to be able to induce the arc in the opposite direction to the movable contact 87*b* as seen from the fixed contact 24*a*.

Although the electromagnetic relay of the first embodiment has four poles, the two permanent magnets 31, 31 can induce arcs, generated respectively between the fixed contacts 21*a*, 22*a*, 23*a*, 24*a* and the movable contacts 86*a*, 86*b*, 87*a*, 87*b*, in desired directions. Hence there is an advantage to being able to obtain a contact mechanism with lower component count, lower man-hour, and higher productivity than those of the conventional example.

In the first embodiment, the description has been given of the configuration where the arcs are induced so as to move upward obliquely to the opposite directions to the movable contacts 86*a*, 87*b* as seen from the fixed contacts 21*a*, 24*a*, for example as illustrated in FIG. 7. However, this is not restrictive, and the positions of the fixed contact 21*a* and the movable contact 86*a*, or the positions of the fixed contact 24*a* and the movable contact 87*b*, may be switched. Even in such a case, it is possible to appropriately select the direction of the magnetic pole of the permanent magnet 31 while making opposite the directions of the currents flowing respectively between the fixed contacts 21*a*, 24*a* and the movable contacts 86*a*, 87*b*. Hence it is possible to induce the arcs so as to move upward obliquely to the opposite directions to the fixed contacts 21*a*, 22*a* as seen from the movable contact 86*a* and the movable contact 86*b*.

In the first embodiment, the permanent magnet 31 and the yoke 32 are combined to constitute the magnetic field generation unit 30. Hence it is possible to induce the arcs generated between the fixed contacts 21*a*, 24*a* and the movable contacts 86*a*, 87*b* to the arc elimination spaces 18, 18, and thereby to effectively eliminate the arcs.

The yoke 32 described above is not restricted to the plate-shaped magnetic member with the substantially gate-shaped section described above, but for example, it may be a plate-shaped magnetic member with a substantially L-shaped section. According to this modified example, it is possible to change the arc inducing direction to a desired direction by changing the direction of the lines of magnetic force generated from the permanent magnet 31 to a different direction.

As illustrated in FIGS. 2 and 3, the electromagnetic block 40 includes a spool 41, a coil 51, an iron core 52, and the yoke 55.

In the spool 41, a through hole 45 with a square section is provided in a trunk 44 having guard portions 42, 43 at both ends. Further, relay clips 50 are engaged in engagement holes 46, provided at both side edges of the other guard portion 43, to retain the spool 41 (FIG. 6).

The coil 51 is wound around the trunk 44, and its lead wire is bound and soldered to binding portions 50*a* (FIG. 2) extended from the relay clips 50.

The iron core 52 is formed by laminating a plurality of plate-shaped magnetic members with a substantially T-shaped surface. By insertion of the iron core 52 through the through hole 45 in the spool 41, one projecting end of the iron core 52 having a projecting shape is made a magnetic pole portion 53, and the other projecting end 54 is caulked and fixed to a vertical portion 57 of the yoke 55 with a substantially L-shaped section which will be described later.

The yoke 55 is made of a magnetic plate bent in a substantially L-shape, and a latching projection 56*a* is bent and raised at the center of a horizontal portion 56 of the yoke 55. Supporting projections 56*b* are cut out from both edges of the tip of the horizontal portion 56. The yoke 55 is shaped such that the lower end 57*a* of the vertical portion 57 can be press-fit into the press-fitting hole 14 in the base 10.

As illustrated in FIGS. 2 and 3, the movable iron piece 60 is made of a plate-shaped magnetic member, and a latching projection 61 is provided in a projecting manner at the upper side edge of the movable iron piece 60. Further, notches 62, 62 are provided at both side edges of the movable iron piece 60.

The movable iron piece 60 is rotatably supported by engaging the notches 62 to the supporting projections 56*b* of the yoke 55 and coupling the latching projection 61 to the latching projection 56*a* of the yoke 55 via a return spring 63.

The movable contact pieces 80, 81 have substantially T-shaped front faces, and have wide portions 82, 83 at both ends at which the movable contacts 86*a*, 86*b*, 87*a*, 87*b* are fixed with conductive backing members 84, 85 interposed. The backing members 84, 85 substantially increase cross sectional areas of the wide portions 82, 83, to reduce electric resistance and suppress generation of heat. Further, as described above, generated arcs are induced so as to move upward obliquely to the opposite directions to the movable contact 86*a* and the movable contact 87*b* as seen from the fixed contacts 21*a*, 24*a*. Hence the arcs hardly come into contact with the movable contact pieces 80, 81 themselves, to reduce deterioration in the movable contact pieces 80, 81 due to the arcs.

Figure 5:
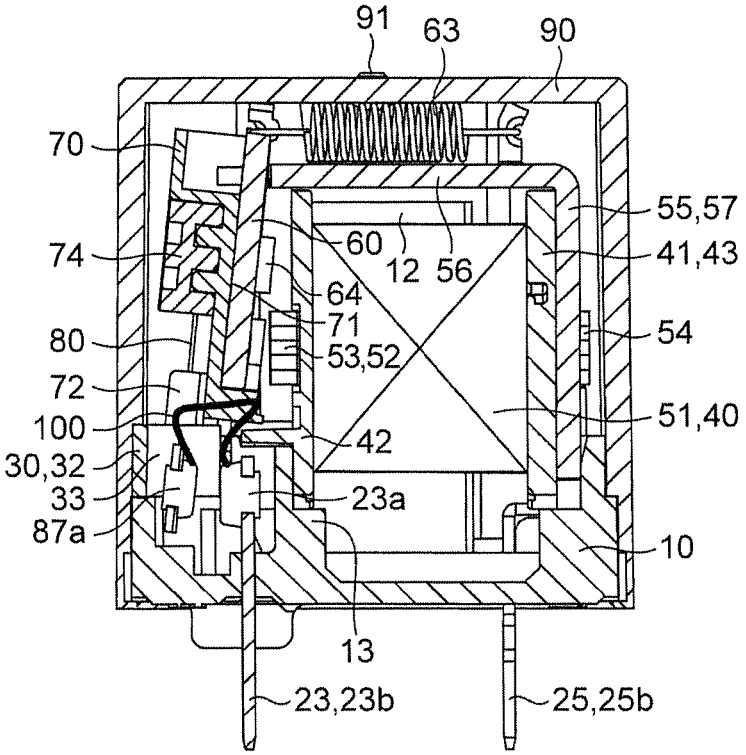
FIG. 5 is a vertical sectional view of the electromagnetic relay illustrated in FIG. 1.

The upper ends of the movable contact pieces 80, 81 are integrated with a movable stage 74 by insertion molding. The movable stage 74 is integrated with a spacer 70 and the movable iron piece 60 via a rivet 64. As illustrated in FIG. 5, the movable iron piece 60 is fitted into a recess 71 provided on the inner surface of the spacer 70, to enhance insulating properties. Further, an insulating rib 72 (FIG. 3) for partitioning the movable contact pieces 80, 81 is provided in a laterally projecting manner at the lower side edge of the outer surface of the spacer 70.

In addition, the electromagnetic block 40 with the movable contact pieces 80, 81 fitted thereto is housed into the base 10, and the guard portion 42 of the spool 41 is mounted on the step 13 of the base 10 (FIG. 5). Further, the lower end 57*a* of the yoke 55 is press-fitted into the press-fitting hole 14 in the base 10 to be positioned. Thereby, the relay clips 50 of the electromagnetic block 40 sandwich the connectors 25*a* of the coil terminals 25 (FIG. 6). Further, the movable contacts 86*a*, 86*b*, 87*a*, 87*b* contactably and separably face the fixed contacts 21*a*, 22*a*, 23*a*, 24*a*, respectively.

As illustrated in FIGS. 2 and 3, the cover 90 has a box shape fittable to the base 10 with the electromagnetic block 40 assembled thereinto. A pair of venting holes 91, 91 are provided on the ceiling surface of the cover 90. Further, a position regulation rib 92 (FIG. 6) is provided in an inward projecting manner on the ceiling surface of the cover 90.

Thus, when the cover 90 is fitted and fixed to the base 10 with the electromagnetic block 40 assembled thereinto, the position regulation rib 92 comes into contact with the horizontal portion 56 of the yoke 55, to regulate rising of the electromagnetic block 40. Moreover, the lower surface of the base 10 is filled with a sealing member (not illustrated) and sealed after solidification, to complete the assembling operation.

Next, the operation of the above-mentioned embodiment will be described.

When the electromagnetic block 40 is not excited, the movable iron piece 60 is biased clockwise by spring force of the return spring 63, as illustrated in FIGS. 5 and 6. Hence the movable contacts 86*a*, 86*b*, 87*a*, 87*b* are separated respectively from the fixed contacts 21*a*, 22*a*, 23*a*, 24*a*.

When a voltage is applied to the coil 51 for excitation, the movable iron piece 60 is attracted to the magnetic pole portion 53 of the iron core 52, and the movable iron piece 60 is rotated counterclockwise against the spring force of the return spring 63. Hence the movable contact pieces 80, 81 are rotated integrally with the movable iron piece 60. As a result, the movable contacts 86*a*, 86*b*, 87*a*, 87*b* respectively come into contact with the fixed contacts 21*a*, 22*a*, 23*a*, 24*a*, and the movable iron piece 60 is then attracted to the magnetic pole portion 53 of the iron core 52.

Subsequently, when the application of the voltage to the coil 51 is stopped, the movable iron piece 60 rotates clockwise by the spring force of the return spring 63. Thus, after separation of the movable iron piece 60 from the magnetic pole portion 53 of the iron core 52, the movable contacts 86*a*, 86*b*, 87*a*, 87*b* separate from the fixed contacts 21*a*, 22*a*, 23*a*, 24*a* to return to the original state.

According to the first embodiment, as illustrated in FIGS. 5 and 6, even when the arc 100 occurs at the time of separation of the movable contacts 86*a*, 86*b*, 87*a*, 87*b* from the fixed contacts 21*a*, 22*a*, 23*a*, 24*a*, respectively, the lines of magnetic force of the permanent magnet 31 act on the arc 100 via the yoke 32. Thus, based on the Fleming's left-hand rule, the generated arc 100 is induced in the direction moving away from the base 10 by the Lorentz force. As a result, for example as illustrated in FIG. 6, the arc 100 generated between the fixed contact 24*a* and the movable contact 87*b* is extended in the direction of the arc elimination space 18 and eliminated. At this time, a dead space located behind each of the fixed contacts 21*a*, 24*a* is effectively used as the arc elimination space 18, and there is thus an advantage to avoiding an increase in size of the device.

Naturally, the shapes, sizes, materials, placement, and the like of the permanent magnet 31 and the yoke 32 are not restricted to those described above, and can be changed as appropriate.

Figure 9:
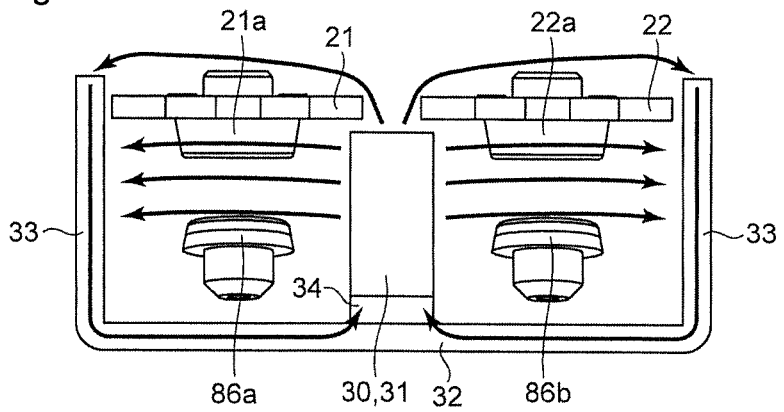
FIG. 9 is a schematic view illustrating a contact mechanism according to a second embodiment of the present invention.

As illustrated in FIG. 9, a second embodiment is a case where arms 33 on both sides of a yoke 32 forming a magnetic field generation unit 30 are extended to positions to cover lateral sides of the fixed contacts 21*a*, 22*a*. Further, a magnetic pole face of a permanent magnet 31 is disposed in a placement spot for the permanent magnet 31 in the yoke 32 with an auxiliary yoke 34 interposed for adjusting the position of the permanent magnet 31.

Note that the auxiliary yoke 34 is included in the yoke 32. The auxiliary yoke 34 may be formed integrally with or separately from the yoke 32, so long as being magnetically coupled with the yoke 32.

According to the second embodiment, it is possible to generate almost parallel lines of magnetic force between the fixed contact 21*a* and the movable contact 86*a* and between the fixed contact 22*a* and the movable contact 86*b*. There is thus an advantage to facilitating control of the arc inducing direction.

Figure 10:
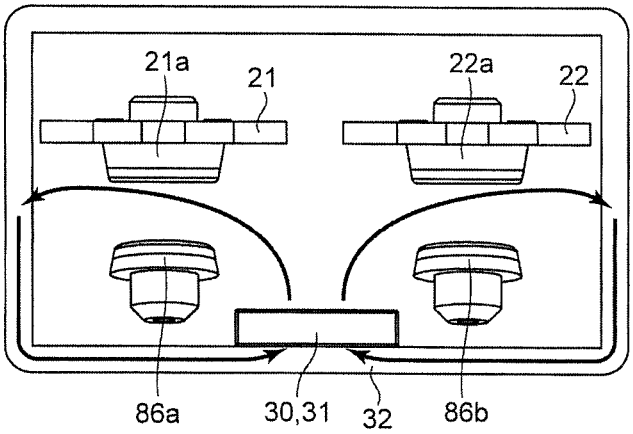
FIG. 10 is a schematic view illustrating a contact mechanism according to a third embodiment of the present invention.

As illustrated in FIG. 10, a third embodiment is a case where a permanent magnet 31 is assembled to the inner side surface of a yoke 32 having a frame shape, to form a magnetic field generation unit 30.

According to the third embodiment, leakage of a magnetic flux is reduced to obtain a magnetic field generation unit with favorable magnetic efficiency.

Figure 11:
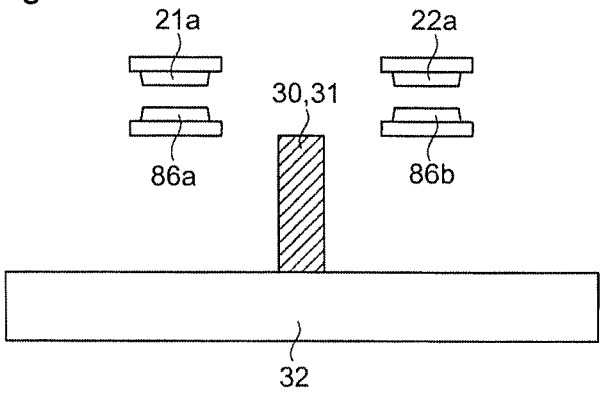
FIG. 11 is a schematic view illustrating a contact mechanism according to a fourth embodiment of the present invention.

As illustrated in FIG. 11, a fourth embodiment is a case where a permanent magnet 31 is assembled in a substantially T-shape to a yoke 32 having a rod shape, to form a magnetic field generation unit 30.

According to the fourth embodiment, since the yoke 32 having a rod shape and being a constituent member has a simple shape, there is an advantage to obtaining a magnetic field generation unit 30 with a good material yield.

Figure 12:
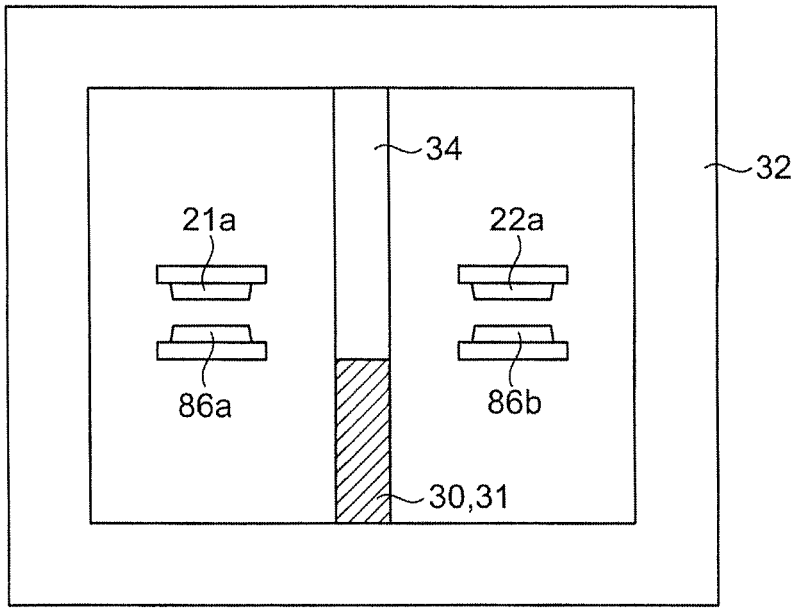
FIG. 12 is a schematic view illustrating a contact mechanism according to a fifth embodiment of the present invention.

As illustrated in FIG. 12, a fifth embodiment is a case where a permanent magnet 31 and an auxiliary yoke 34 are provided across the inside of a yoke 32 having a frame shape, to form a magnetic field generation unit 30.

According to the fifth embodiment, leakage of a magnetic flux is further reduced to obtain a magnetic field generation unit with favorable magnetic efficiency.

Example 1

Figure 13:
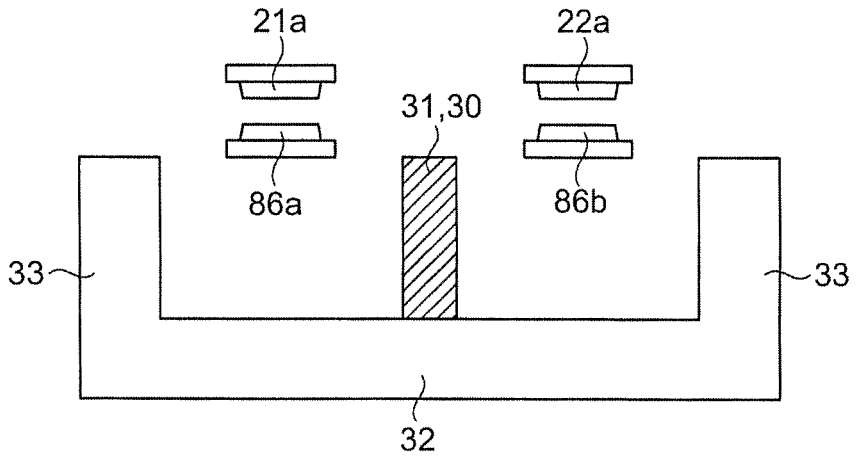
FIG. 13 is a schematic view illustrating Example 1 of a contact mechanism according to one or more embodiments of the present invention.
Figure 14:
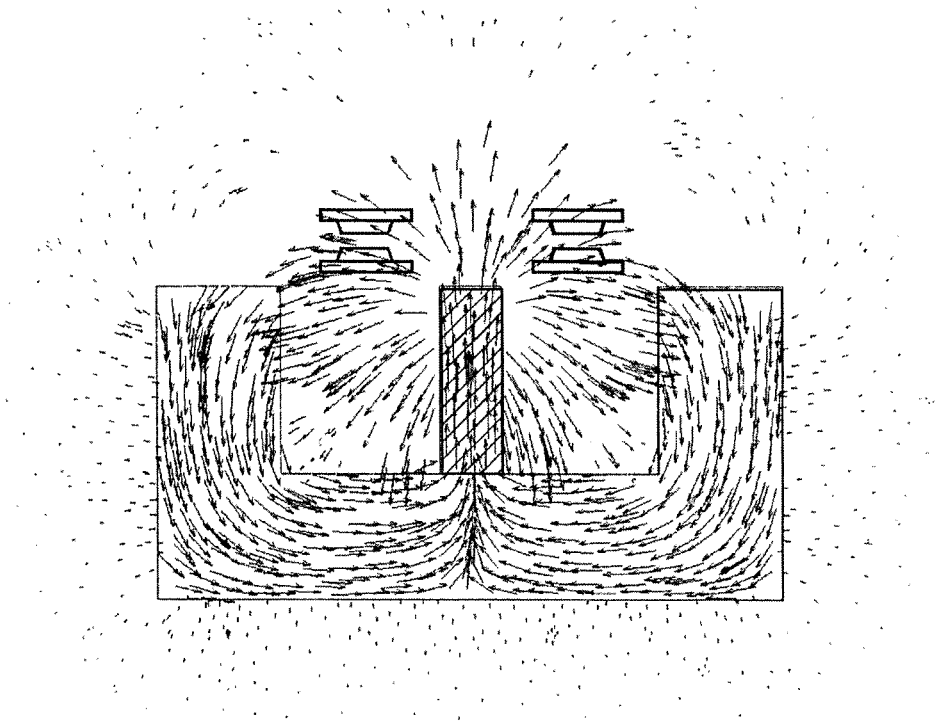
FIG. 14 is a distribution diagram of lines of magnetic force in the contact mechanism illustrated in FIG. 13.

A distribution of lines of magnetic force that a contact mechanism (FIG. 13) based on the first embodiment has was analyzed. FIG. 14 illustrates a result of the analysis.

As apparent from FIG. 14, it was confirmed that the directions of the lines of magnetic force, generated from the permanent magnet 31, respectively between the fixed contact 21*a* and the movable contact 86*a* and between the fixed contact 22*a* and the movable contact 86*b* are opposite directions.

That is, according to the contact mechanism, when currents in opposite directions are allowed to flow respectively between the fixed contact 21*a* and the movable contact 86*a* and between the fixed contact 22*a* and the movable contact 86*b*, one permanent magnet 31 can induce generated arcs in the same direction. It was thus found that a contact mechanism with low component count, low assembly man-hour, and high productivity can be obtained.

Example 2

Figure 15:
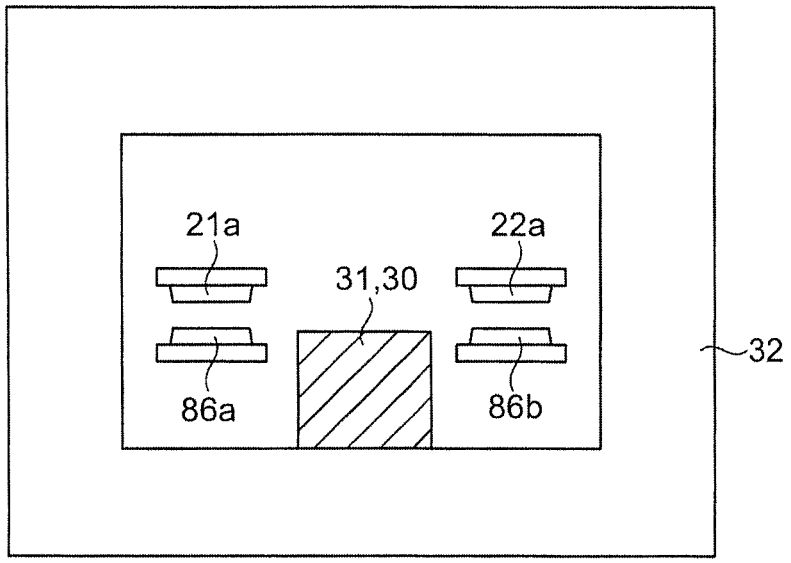
FIG. 15 is a schematic view illustrating Example 2 of a contact mechanism according to one or more embodiments of the present invention.
Figure 16:
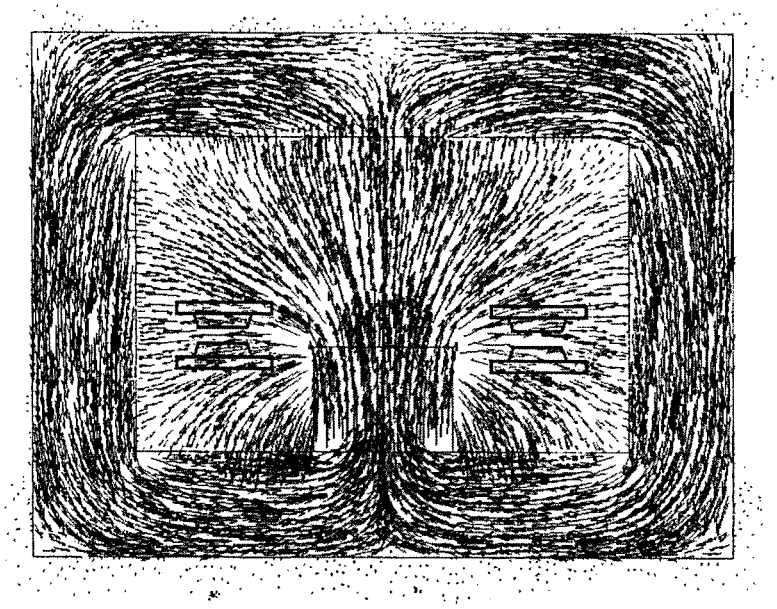
FIG. 16 is a distribution diagram of lines of magnetic force in the contact mechanism illustrated in FIG. 15.

A distribution of lines of magnetic force that a contact mechanism (FIG. 15) based on the third embodiment has was analyzed. FIG. 16 illustrates a result of the analysis.

As apparent from FIG. 16, the directions of the lines of magnetic force, generated from the permanent magnet 31, respectively between the fixed contact 21*a* and the movable contact 86*a* and between the fixed contact 22*a* and the movable contact 86*b* are opposite directions. It was confirmed therefrom that the lines of magnetic force generated from the permanent magnet 31 form a magnetic circuit via the yoke 32 having a frame shape.

That is, according to the contact mechanism, when currents in opposite directions are allowed to flow between the fixed contact 21*a* and the movable contact 86*a* and between the fixed contact 22*a* and the movable contact 86*b*, one permanent magnet 31 can induce generated arcs in the same direction and reduce leakage of the magnetic flux. It was thus found that a contact mechanism with low component count and favorable magnetic efficiency can be obtained.

Needless to say, the permanent magnet 31 is not restricted to being disposed on the movable contact side, but may be disposed on the fixed contact side.

Naturally, the contact mechanism according to one or more embodiments of the present invention may be applied not only to the contact mechanism having a so-called double break contact structure described above, but also to a contact mechanism having a twin contact structure.

Also naturally, the contact mechanism may be applied not only to the above-mentioned electromagnetic relay, but also to another electromagnetic relay or a switch.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

10 Base
11 Depression
12 Partition
13 Step
14 Press-fitting hole
15*a*, 15*b*, 15*c*, 15*d* Terminal hole
16 Terminal hole
17 Guiding recess
18 Arc elimination space
21-24 Fixed contact terminal
21*a*-24*a* Fixed contact
25 Coil terminal
25*a* Connector
25*b* Terminal portion
30 Magnetic field generation unit
31 Permanent magnet
32 Yoke
40 Electromagnetic block
41 Spool
42, 43 Guard portion
44 Trunk
45 Through hole
46 Engagement hole
50 Relay clip
51 Coil
52 Iron core
53 Magnetic pole portion
55 Yoke
60 Movable iron piece
70 Spacer
71 Recess
72 Insulating rib
74 Movable stage
80 Movable contact piece
81 Movable contact piece
82 Wide portion
83 Wide portion
84 Backing member
85 Backing member
86*a*, 86*b* Movable contact
87*a*, 87*b* Movable contact
90 Cover
91 Venting hole
92 Position regulation rib
100 Arc

The invention claimed is:

1. A contact mechanism comprising:

a base;

a pair of fixed contact terminals provided side by side on the base;

a first contact mechanism comprising:

a first fixed contact provided in one of the pair of fixed contact terminals, and a first movable contact that contactably and separably faces the first fixed contact;

a second contact mechanism comprising:

a second fixed contact provided in another of the pair of fixed contact terminals, and a second movable contact that contactably and separably faces the second fixed contact; and a magnetic field generation unit comprising a permanent magnet disposed between the first contact mechanism and the second contact mechanism such that magnetic fields in opposite directions are generated respectively between contacts of the first contact mechanism and between contacts of the second contact mechanism when currents in opposite directions flow in the first contact mechanism and the second contact mechanism, wherein the magnetic field generation unit is disposed in the base so as to induce arcs generated in the first contact mechanism and the second contact mechanism in directions moving away from the base.

2. The contact mechanism according to claim 1, wherein the magnetic field generation unit has a yoke in contact with the permanent magnet.

3. The contact mechanism according to claim 2, wherein the yoke has a gate shape with a pair of arms facing each other across the first contact mechanism and the second contact mechanism.

4. The contact mechanism according to claim 3, wherein the yoke has a frame shape surrounding the first contact mechanism and the second contact mechanism.

5. An electromagnetic relay comprising the contact mechanism according to claim 3.

6. The contact mechanism according to claim 2, wherein the yoke has a frame shape surrounding the first contact mechanism and the second contact mechanism.

7. An electromagnetic relay comprising the contact mechanism according to claim 6.

8. An electromagnetic relay comprising the contact mechanism according to claim 2.

9. An electromagnetic relay comprising the contact mechanism according to claim 1.

10. The contact mechanism according to claim 1, wherein the magnetic field generation unit has a yoke in contact with the permanent magnet.

* * * * *